US009383094B2

(12) United States Patent
Alifano et al.

(10) Patent No.: US 9,383,094 B2
(45) Date of Patent: Jul. 5, 2016

(54) FRACTURING APPARATUS

(71) Applicant: Orbital ATK, Inc., Dulles, VA (US)

(72) Inventors: Joseph A. Alifano, Commack, NY (US); Daniel Tilmont, Rocky Point, NY (US)

(73) Assignee: Orbital ATK, Inc., Plymouth, MN (US)

( * ) Notice: Subject to any disclaimer, the term of this patent is extended or adjusted under 35 U.S.C. 154(b) by 387 days.

(21) Appl. No.: 13/840,672

(22) Filed: Mar. 15, 2013

(65) Prior Publication Data

US 2013/0341026 A1 Dec. 26, 2013

Related U.S. Application Data

(60) Provisional application No. 61/664,015, filed on Jun. 25, 2012.

(51) Int. Cl.

| | |
|---|---|
| ***E21B 43/26*** | (2006.01) |
| ***F22B 1/18*** | (2006.01) |
| ***E21B 36/02*** | (2006.01) |
| ***E21B 43/243*** | (2006.01) |
| ***E21B 43/263*** | (2006.01) |

(Continued)

(52) U.S. Cl.

CPC ..... *F22B 1/1853* (2013.01); *E21B 36/02* (2013.01); *E21B 43/122* (2013.01); *E21B 43/24* (2013.01); *E21B 43/243* (2013.01); *E21B 43/26* (2013.01); *E21B 43/263* (2013.01); *F22B 27/02* (2013.01); *F22B 27/12* (2013.01); *F23D 14/02* (2013.01); *F23D 14/70* (2013.01); *F23Q 7/00* (2013.01); *F23R 3/343* (2013.01); *Y10T 137/0329* (2015.04)

(58) Field of Classification Search

CPC ..... E21B 43/263

USPC ..... 166/299, 63, 308.1

See application file for complete search history.

(56) References Cited

U.S. PATENT DOCUMENTS

| | | | |
|---|---|---|---|
| 2,707,029 | A | 4/1955 | Van Hartesveldt |
| 2,803,305 | A | 8/1957 | Behning et al. |

(Continued)

FOREIGN PATENT DOCUMENTS

| | | | |
|---|---|---|---|
| DE | 3921581 | A1 | 10/1990 |
| EP | 2 199 538 | A2 | 6/2010 |

(Continued)

OTHER PUBLICATIONS

International Search Report for Application No. PCT/US2013/047273 mailed Oct. 7, 2013.

(Continued)

*Primary Examiner* — Sunil Singh

(74) *Attorney, Agent, or Firm* — TraskBritt

(57) ABSTRACT

A fracturing apparatus in a wellbore, having a housing with at least one injection port; an injection fluid supply interface to provide injection fluid for the fracturing apparatus; and at least one high pressure combustor received within the housing. The housing further includes a combustible medium interface that is in fluid communication with the at least one high pressure combustor, which is configured and arranged to provide repeated ignition cycles that include a combustion cycle that ignites the combustible medium and a fuel delivery cycle that delivers the combustible medium to the combustor, wherein pressure resulting from the combustion cycle forces the injection fluid out an injection port to cause fracturing in a portion of the earth around the wellbore.

20 Claims, 6 Drawing Sheets

(51) Int. Cl.

| | |
|---|---|
| ***F23D 14/02*** | (2006.01) |
| ***F23D 14/70*** | (2006.01) |
| ***F23Q 7/00*** | (2006.01) |
| ***E21B 43/12*** | (2006.01) |
| ***E21B 43/24*** | (2006.01) |
| ***F23R 3/34*** | (2006.01) |
| ***F22B 27/02*** | (2006.01) |
| ***F22B 27/12*** | (2006.01) |

(56) References Cited

U.S. PATENT DOCUMENTS

| | | | | |
|---|---|---|---|---|
| 3,223,539 | A | | 12/1965 | Hyde et al. |
| 3,284,137 | A | | 11/1966 | Wolber |
| 3,456,721 | A | | 7/1969 | Smith |
| 3,482,630 | A | | 12/1969 | Earlougher, Jr. |
| 3,522,995 | A | | 8/1970 | Erickson |
| 3,674,093 | A | * | 7/1972 | Reese ..... 166/299 |
| 3,710,767 | A | | 1/1973 | Smith |
| 4,050,515 | A | * | 9/1977 | Hamrick et al. ..... 166/303 |
| 4,205,725 | A | | 6/1980 | Howard et al. |
| 4,237,973 | A | | 12/1980 | Todd |
| 4,243,098 | A | | 1/1981 | Meeks et al. |
| 4,336,839 | A | | 6/1982 | Wagner et al. |
| 4,377,205 | A | | 3/1983 | Retallick |
| 4,380,265 | A | | 4/1983 | Mohaupt |
| 4,380,267 | A | | 4/1983 | Fox |
| 4,385,661 | A | | 5/1983 | Fox |
| 4,390,062 | A | | 6/1983 | Fox |
| 4,397,356 | A | | 8/1983 | Retallick |
| 4,411,618 | A | | 10/1983 | Donaldson et al. |
| 4,421,163 | A | | 12/1983 | Tuttle |
| 4,431,069 | A | | 2/1984 | Dickinson, III et al. |
| 4,442,898 | A | | 4/1984 | Wyatt |
| 4,458,756 | A | | 7/1984 | Clark |
| 4,463,803 | A | | 8/1984 | Wyatt |
| 4,471,839 | A | | 9/1984 | Snavely et al. |
| 4,498,531 | A | | 2/1985 | Vrolyk |
| 4,522,263 | A | | 6/1985 | Hopkins et al. |
| 4,558,743 | A | | 12/1985 | Ryan et al. |
| 4,648,835 | A | | 3/1987 | Eisenhawer et al. |
| 4,682,471 | A | | 7/1987 | Wagner |
| 4,699,213 | A | | 10/1987 | Fleming |
| 4,718,489 | A | | 1/1988 | Hallam et al. |
| 4,783,585 | A | | 11/1988 | Meshekow |
| 4,805,698 | A | | 2/1989 | Baugh et al. |
| 4,834,174 | A | | 5/1989 | Vandevier |
| 4,895,206 | A | | 1/1990 | Price |
| 5,052,482 | A | | 10/1991 | Gondouin |
| 5,205,360 | A | * | 4/1993 | Price ..... 166/308.1 |
| 5,211,230 | A | | 5/1993 | Ostapovich et al. |
| 5,339,897 | A | | 8/1994 | Leaute |
| 5,355,802 | A | | 10/1994 | Petitjean |
| 5,525,044 | A | | 6/1996 | Chen |
| 5,623,576 | A | | 4/1997 | Deans |
| 5,623,819 | A | | 4/1997 | Bowker et al. |
| 5,676,097 | A | | 10/1997 | Montresor |
| 5,775,426 | A | | 7/1998 | Snider et al. |
| 6,047,788 | A | | 4/2000 | Bohner et al. |
| 6,959,760 | B1 | | 11/2005 | Braithwaite et al. |
| 7,493,952 | B2 | | 2/2009 | Ayasse |
| 7,497,253 | B2 | | 3/2009 | Retallick et al. |
| 7,628,204 | B2 | | 12/2009 | Iqbal et al. |
| 7,640,987 | B2 | | 1/2010 | Kalman et al. |
| 7,665,525 | B2 | | 2/2010 | Pfefferle |
| 7,712,528 | B2 | | 5/2010 | Langdon et al. |
| 7,784,533 | B1 | | 8/2010 | Hill |
| 7,946,342 | B1 | | 5/2011 | Robertson |
| 8,091,625 | B2 | | 1/2012 | Ware et al. |
| 2007/0284107 | A1 | | 12/2007 | Crichlow |
| 2008/0017381 | A1 | | 1/2008 | Baiton |
| 2008/0087427 | A1 | | 4/2008 | Kaminsky et al. |
| 2009/0260811 | A1 | | 10/2009 | Cui et al. |
| 2009/0288827 | A1 | | 11/2009 | Coskuner |
| 2010/0021323 | A1 | | 1/2010 | Schubert |
| 2010/0181069 | A1 | | 7/2010 | Schneider et al. |
| 2010/0224370 | A1 | | 9/2010 | Donnelly et al. |
| 2011/0000666 | A1 | | 1/2011 | Couto |
| 2011/0120710 | A1 | | 5/2011 | Dong et al. |
| 2011/0127036 | A1 | | 6/2011 | Tilmont et al. |
| 2011/0227349 | A1 | | 9/2011 | Huber et al. |
| 2011/0297374 | A1 | | 12/2011 | Kuhlman et al. |
| 2013/0161007 | A1 | | 6/2013 | Wolfe et al. |

FOREIGN PATENT DOCUMENTS

| | | | |
|---|---|---|---|
| FR | 823481 | A | 1/1938 |
| GB | 145209 | | 7/1920 |
| GB | 2 287 312 | A | 9/1995 |
| WO | WO 00/15962 | | 3/2000 |
| WO | WO 2006/063200 | A2 | 6/2006 |
| WO | WO 2011/103190 | A1 | 8/2011 |
| WO | WO 2012/150862 | A2 | 11/2012 |

OTHER PUBLICATIONS

Blogspot.com, Centrifugal Pump/Deep Well Pump/Sump Pump [online], Aug. 1, 2008, [retrieved on Nov. 26, 2013]. Retrieved from the internet <http://pump-detail.blogspot.com/2008_08_01_archive.html>, 14 pages.

International Written Opinion for Application No. PCT/US2013/047273 mailed Oct. 7, 2013, eight (8) pages.

International Preliminary Report on Patentability for Application No. PCT/US2013/047273, dated Dec. 31, 2014, nine (9) pages.

* cited by examiner

FRACTURING APPARATUS

CROSS-REFERENCE TO RELATED APPLICATION

This application claims priority to U.S. Provisional Patent Application Ser. No. 61/664,015 titled "Apparatus and Methods Implementing a Downhole Combustor" filed on Jun. 25, 2012, which is incorporated herein in its entirety by this reference.

BACKGROUND

Hydraulic fracturing has become a primary method for stimulating mature reservoirs and newer shale gas/oil reserves. The benefits of fracturing post-perforated wellbores are well known and this method has been able to increase productivity or access to previously non-producible reserves. These benefits, however, come with financial costs and environmental concerns. A tremendous amount of water is required during hydraulic fracturing of deep horizontal wells. Millions of gallons of water can be consumed to stimulate a single deep horizontal well. Typical costs for hydraulic fracturing include, pressurizing, pumping, and disposing of water after the job is complete.

BRIEF SUMMARY

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a fracturing apparatus is provided that includes a housing, an injection fluid supply interface and at least one high pressure combustor. The housing is configured to be positioned down a wellbore. The housing has at least one injection port. The injection fluid supply interface provides injection fluid for the hydraulic fracturing apparatus. The at least one high pressure combustor is received within the housing. The housing has a combustible medium interface that is in fluid communication with the at least one high pressure combustor. The at least one high pressure combustor is configured and arranged to provide repeated ignition cycles that include a combustion cycle that ignites the combustible medium and a fuel delivery cycle that delivers the combustible medium to the combustor, wherein pressure resulting from the combustion cycle forces the injection fluid out the at least one injection port to cause fracturing in a portion of the earth around the wellbore.

In another embodiment, another fracturing apparatus is provided that includes a housing, an injection fluid supply interface, an injection fluid conduit and at least one high pressure combustor. The housing is configured to be positioned down a wellbore. The housing has a plurality of spaced injection ports. Moreover, the housing further has an injection volume holding chamber configured to hold an injection fluid volume. An injection fluid supply interface is used to provide an injection fluid for the hydraulic fracturing apparatus. The injection volume holding chamber is in fluid communication with the injection fluid supply interface. The injection fluid conduit provides a path within the housing between the injection fluid supply interface and the injection volume holding chamber of the housing. The at least one high pressure combustor is received within the housing. The housing further has a combustible medium interface that is in fluid communication with the at least one high pressure combustor. The at least one high pressure combustor is configured and arranged to provide repeated ignition cycles that include a combustion cycle that combusts the combustible medium and a fuel delivery cycle that delivers the combustible medium to the combustor, wherein pressure resulting from the combustion cycle forces the injection fluid out the at least one injection port therein causing fracturing in a portion of the earth around the wellbore.

In still another embodiment, a method of downhole fracturing is provided. The method includes: placing a housing with at least one high pressure combustor down a wellbore; and creating oscillating pressure with the at least one high pressure combustor to cause micro fracturing in an area of the earth by the wellbore.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout the figures and text.

DETAILED DESCRIPTION

In the following detailed description, reference is made to the accompanying drawings, which form a part hereof, and in which is shown by way of illustration specific embodiments in which the invention may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments of the present invention provide a fracturing apparatus or apparatus for initiating and propagating fractures. Embodiments employ a downhole combustor to create oscillating pressure pulses to propagate fractures. In some embodiments, the fracturing apparatus is part of a system that includes a fuel, reactor or other fuel reformer on the surface (e.g., a catalytic partial oxidation (CPOX)), a control system for delivery of fuel and downhole oxidizer and an ignition source. A fuel, such as, but not limited to, natural gas, propane, methane, diesel would be run through the reactor so that the end constituents would be gaseous and predictably combustible in the downhole environment. This allows production of a synthetic fuel including mostly gaseous CO, $H_2$ and simple hydrocarbons for highly efficient and stable combustion. Gaseous fuels will improve mixing with a gaseous oxidizer, such as air and enable surface processing of various fuels for delivery to the fracturing apparatus 100. The fracturing apparatus 100 may be used in a wellbore (not shown) in an earth formation (not shown).

Figure 1:
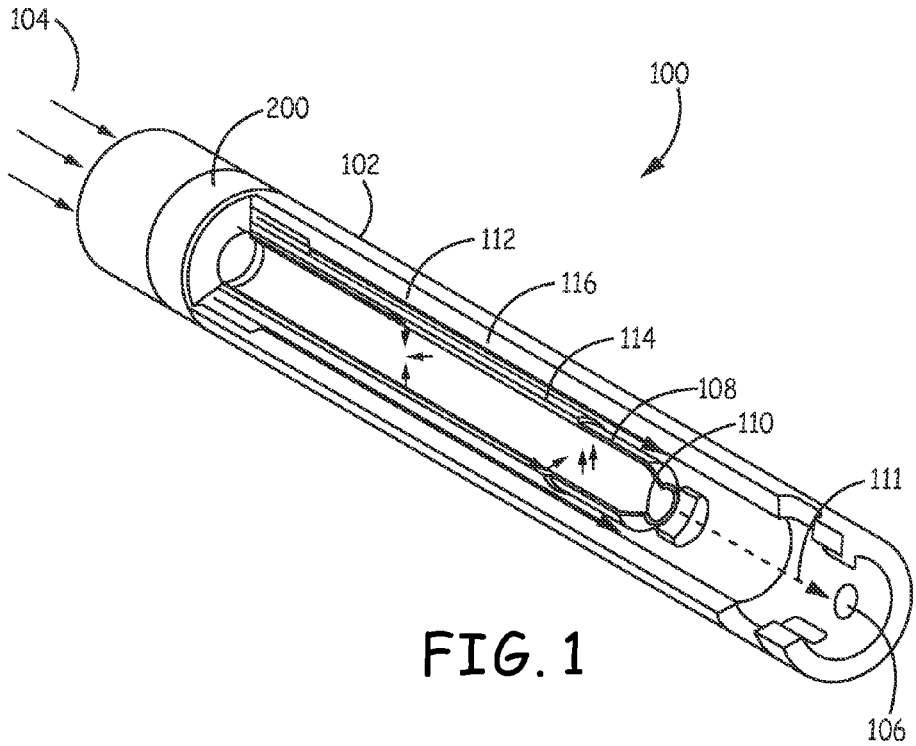
FIG. 1 is a cross-sectional side view of one embodiment of a downhole fracturing apparatus.

Referring to FIG. 1, a fracturing apparatus 100 includes a housing or body 102 that is generally tubular and closed except for delivery interfaces 104 such as inlet ports or conduits on one end. The delivery interfaces 104 may allow passage and delivery into the fracturing apparatus 100 for gas and fluids (e.g., air, fuel, and other fluids such as combustible medium) and power to initiate an ignition system 200 (combustor). The fluids that may be input into the housing include, for example, fracturing injection fluids. The housing 102 further has a plurality of injection ports or outlet ports 106 that are positioned in an end of housing 102 opposite the delivery interfaces 104. The injection ports 106 allow for expelling or delivery of combusted gases and hydraulic fluids (injection fluids).

Enclosed within housing 102 of the embodiment of FIG. 1 is a combustion tube 108. The combustion tube 108 runs a select length of housing 102 and tapers or narrows toward the direction of outlet ports 106 to form a nozzle or venturi 110. Between the venturi 110 and the outlet ports or injection ports 106 is a space or area, an injection volume holding chamber 111 that allows mixing of the combusted gases and fluid before being expelled through the outlet ports 106 in this embodiment. In some embodiments, the outlet ports 106 include or are covered by a flow control valve, which valve is discussed below with regard to the embodiment described in FIG. 2.

A combustor 200 (such as ignition system 200 described below in relation to FIGS. 5, 6A, 6B and 7) is positioned to combust the combustible medium in the combustion tube 108. In some embodiments, the housing includes passages 112 that are aligned with delivery interfaces 104. The passage 112 may be formed between the outer or external portion of cylinder 114 and internal portion of housing 116 and extend through the length of housing 102. The combustion of the gases and fuel raises the temperature in the combustion chamber. The heat formed from the hot gases causes the gases to expand and move toward the venturi 110. In one embodiment, the gas will reach sonic velocity in the venturi 110. In other embodiments, the velocity of the gas will remain below the sonic limit. The rise in temperature of the cylinder 114 also raises the temperature of the fluid running along passages 112. One important benefit of the increase in temperatures is the increase in temperature of injection fluid (or fracture fluid) that reduces the density of the injection fluid therein allowing for less liquid delivery per unit of stimulated volume (i.e., hotter liquid takes up more space than the same liquid at a lower temperature). The heated fluid also has a lower viscosity, which can be a tremendous advantage. A 100° F. increase in temperature can drop the viscosity by more than 50%. This can either eliminate or reduce the amount of friction reducer used in many fracturing operations. The high temperature, high pressure exhaust products exit out the venturi 110 and into an injection volume holding chamber 111 where it mixes with hydraulic fluid (injection volume). The mixture is then forced out the outlet ports 106 to fracture an area of the earth near the fracturing apparatus. The combustion is operated in a repeated fashion to produce pulsating force to induce fracturing.

Figure 2:
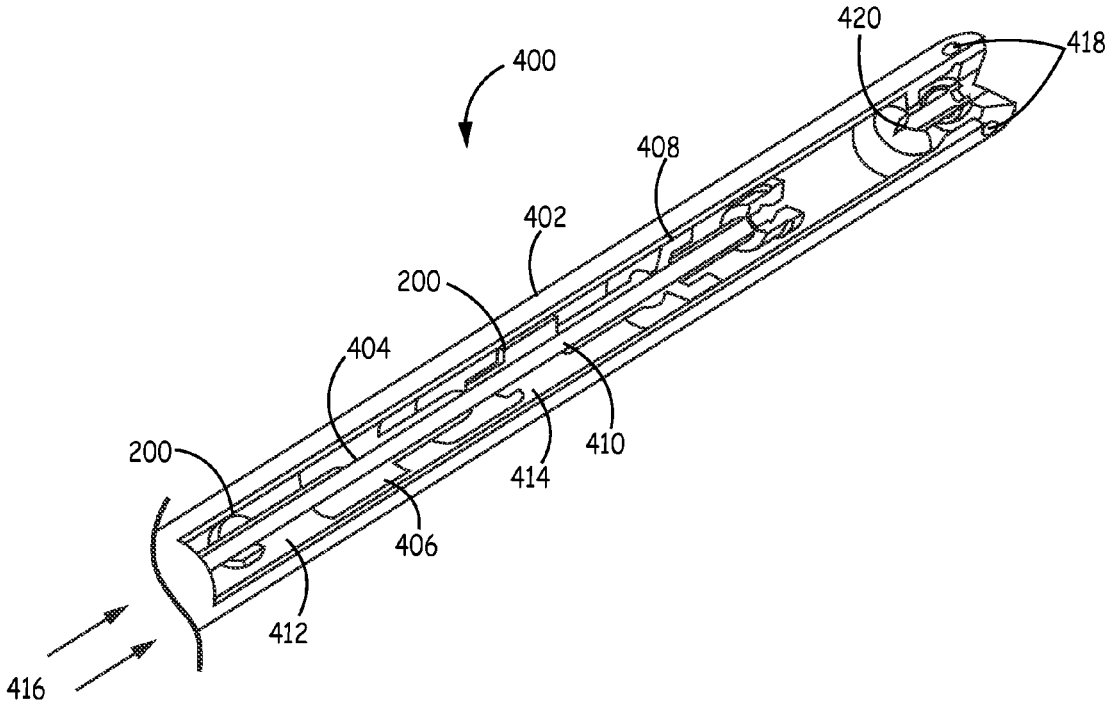
FIG. 2 is a cross-sectional side view of another embodiment of a downhole fracturing apparatus.

Referring to FIG. 2, another embodiment of fracturing apparatus 400 is illustrated. Fracturing apparatus 400 is generally a housing or body 402 enclosing a piston 404. Piston 404 has a combustion piston head 406 and an injection fluid piston head 408, the piston heads 406 and 408 are connected via a shaft or rod 410.

Piston 404 subdivides the cylinder into two chambers, a primary combustion chamber 412 and a secondary combustion chamber 414. Piston 404 is slidably disposed within the primary combustion chamber 412 and during an injection stroke may slidaby move to secondary combustion chamber 414. The primary combustion chamber 412 defines a first compression stage and the secondary combustion chamber 414 defines the second compression stage. Primary combustion chamber 412 and secondary combustion chamber 414 may be adjacent to one another and may be of the same size or different sizes. The two combustion chambers 412, 414 may be in communication, by way of conduits and control valves (not shown). Each combustion chamber 412, 414 has its own ignition system 200.

At one end of housing 402 are included inlet ports or injection fluid supply interface 416. The inlet ports 416 provide air, fuel (combustible medium) and fracture liquid, which can include water and propellants plus a number of chemical additives, as well as a connection or port (not shown) to deliver power to ignition system 200. At an end opposite of inlet ports 416 are injection or exhaust ports 418. Injection or exhaust ports 418 are configured to have one-way flow control valves 420. In an embodiment, the downhole fracturing apparatus 400 has a passive control system that utilizes a positive pressure differential to inject gases into primary combustion chamber 412.

Figure 3:
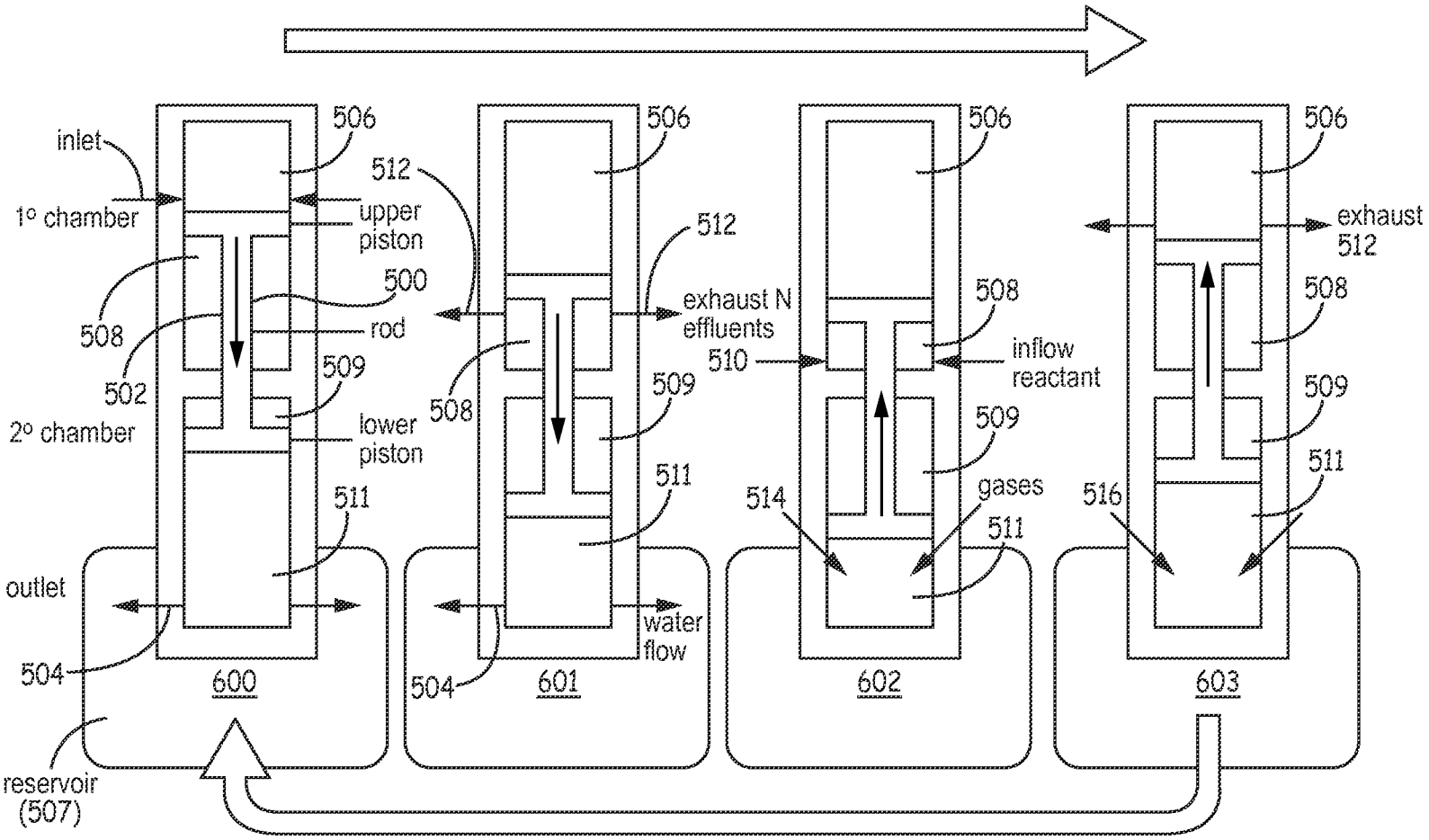
FIG. 3 is a block diagram depicting the working of the embodiment shown in FIG. 2.
Figure 4A:
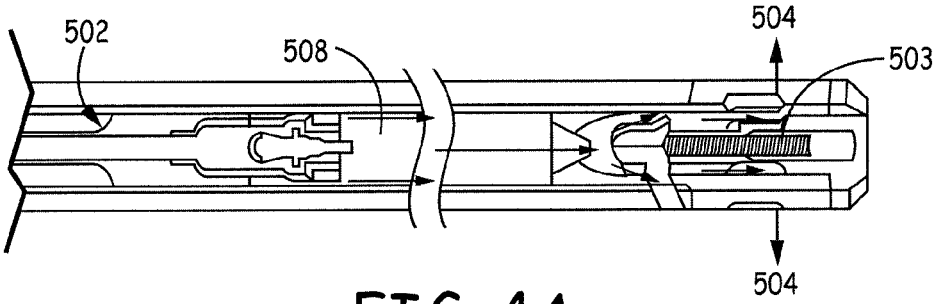
FIGS. 4A and 4B show the cross-sectional side view of FIG. 2 depicting the direction of piston movement.
Figure 4B:
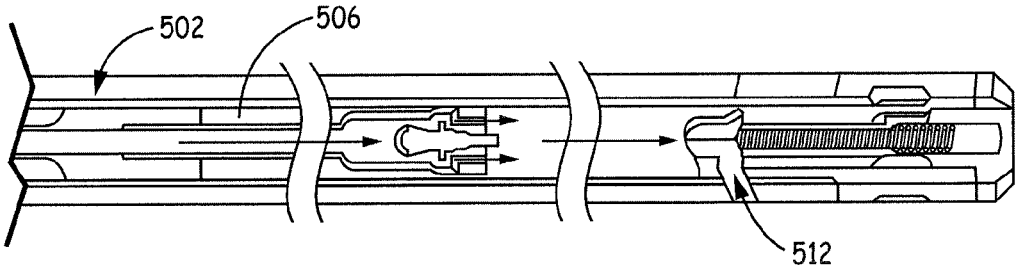

Referring to FIGS. 3, 4A and 4B, gases are ignited with a modified version of the high pressure ignition system 200 described below. Upon ignition of the gas mixture, the piston 502 performs an injection stroke in the direction of arrow 500 thereby compressing a spring (not shown) and moving the piston 502 in the direction toward the outlet ports 504 (via an isolation valve 503), which displaces downhole fluid and raises reservoir pressure to initiate and propagate fractures.

The pressure and the fuel to air ratio in a primary combustion chamber 506, as well as the area ratio that exist in the fracturing apparatus, are set based on wellbore conditions so that the work performed on the piston 502 cools the combustion gases sufficiently for injection into the wellbore. Warm post combustion gases are vented into the reservoir 507 via the outlet ports 504. The expansion of the primary combustion chamber 506, due to combustion, pressurizes the hydraulic or injection fluid. On the pressurization stroke, the piston 502 will force the fluids into the reservoir 507 under high pressure. Check valves are used to control the direction of the flow.

A low pressure chamber 509 (1 atm) opposing the injection volume 511 maintains a differential force that acts to compress the primary combustion chamber 506 once all the available work is extracted. During the start of the return stroke, the primary combustion chamber 506 is compressed and fracturing fluid (injection fluid) is drawn into the injection volume 511. This compression of the primary combustion chamber 506 drives spent air and fuel (effluent) out of the exhaust ports 512 of a secondary combustion chamber 508. The return stroke is initiated by the low pressure chamber 509 and in some cases by a compressed spring (not shown) which increases the volume of the secondary combustion chamber 508 thus pulling fresh fuel and air (or another oxidant) 516 into the secondary combustion chamber 508, which will be ignited driving the piston 502 back to its initial position. Upon ignition, the secondary combustion chamber 508 pressurizes. The combination of forces acting on the pistons 502 compresses a coiled spring (not shown) in the primary combustion chamber 506. The same cooling and venting scheme is applied to the secondary combustion chamber 508. Upon venting sufficient gas pressure from the secondary combustion chamber 508, the spring in the primary combustion chamber 506 returns to its initial state, retracting piston 502. The expansion of the primary combustion chamber 506 creates suction. This will draw fuel and air into the primary combustion chamber 506. Once the primary combustion chamber 506 is sufficiently filled, the ignition system causes another combustion wave to pressurize the primary combustion chamber 506 and the process repeats.

The housing 402 has outlets that vent the combined hydraulic fluids and combustion byproducts into the formation. This cycle is repeated with the net effect being a controlled pressurization of the wellbore that utilizes the high pressure/moderate temperature gas from the combustion process and wellbore fluid drawn from the formation to hydraulically fracture the formation. In one embodiment, high pressure combustion is performed at 6000 psi. In another embodiment, the wellbore pressure may be or about 5500 to 6000 psi with delivered pressures of 5900 psi to 6400, respectively.

The above-described fracturing tools generate a warm high gas content foam that is greater than 50% gas by volume from a combination of hot exhaust gas from the combustor and the injection fluid near the wellbore to initiate micro fracturing. In another embodiment, a low gas content foam is created by adjusting the air-fuel and liquid supply. Moreover, this foam will convert to a low gas content foam by condensation and the cooling of the hot exhaust gas that has high bulk molecules to support fractures deeper into the formation as the foam gets further away from the fracturing apparatus.

In other embodiments, the fracturing tools 100 or 400 may be augmented with known solid propellant systems. By combining the fracturing tools 100 or 400 with a propellant system, pressure profiles may be tailored to the desired wellbore conditions. Combining of the two systems also provide for sustained pressures as compared to known systems (e.g., gas guns) that provide for single pressure pulses. In one embodiment, the combined system or the disclosed systems may be used to effectively apply Paris' law for fatigue crack growth. Paris' law has traditionally been used to determine a rate of crack growth as a component (e.g., a reservoir or wellbore) is subjected to repetitive fatigue conditions. In other words, as a reservoir or wellbore is subjected to repetitive or cyclic fatigues, or forces, such as a repetitive or cyclic pressure, a crack can develop in the reservoir or wellbore.

Paris' law can be described mathematically as $da/dN=C(\Delta K)^m$ where a is the half crack length, N is the number of fatigue cycles, da/dN is the rate of change of the half crack length with respect to the number of fatigue cycles, C is a material constant of the crack growth equation and a crack geometry, and m is an exponent that may be selected based on the material type to be analyzed. $\Delta K$ is the range of a stress intensity factor K, where K may be based on a loading state.

Figure 5:
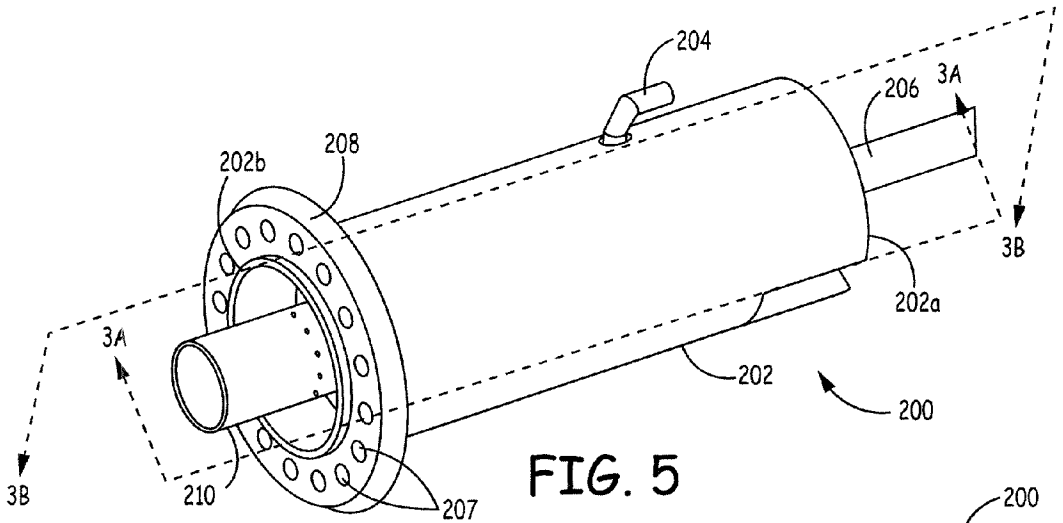
FIG. 5 is a side perspective view of a combustor of one embodiment of the present invention.
Figure 6B:
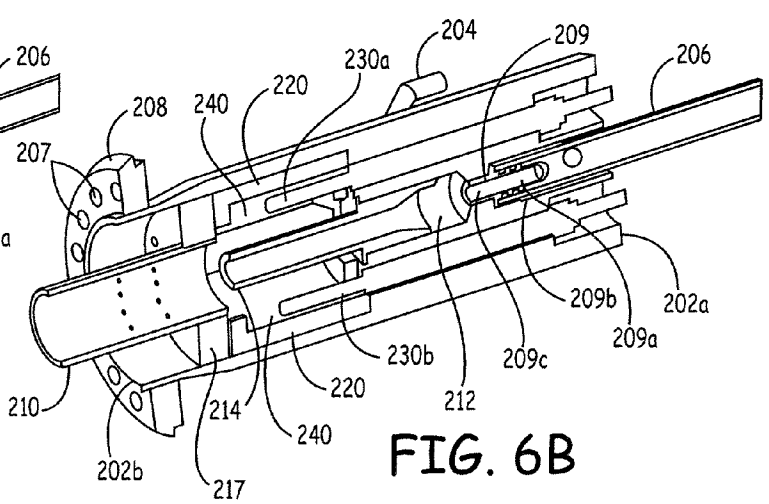
FIG. 6B is a cross-sectional view along line 3B-3B of the combustor of FIG. 5.

The ignition system and combuster 200 described above is illustrated in FIGS. 5 through 7. FIG. 5 is a side perspective view of the combustor 200 which includes an injector body 202. The injector body 202 is generally cylindrical in shape having a first end 202*a* and a second end 202*b*. A fuel inlet tube 206 enters the first end of the injection body 202 to provide fuel to the combustor 200. As also illustrated in FIGS. 5 and 6B, a premix air inlet tube 204 passes through the injector body 202 to provide a flow of air to the combustor 200. A burner (such as but not limited to an air swirl plate 208) is coupled proximate the second end of the injector body 202. The air swirl plate 208 includes a plurality of angled air passages 207 that cause air passed through the air passages 207 to flow into a vortex. Also illustrated in FIG. 5 is a jet extender 210 that extends from the second end 202*b* of the injector body 202. In particular, the tubular shaped jet extender 210 extends from a central passage of a fuel injector plate 217 past the second end 202*b* of the injector body 202. The jet extender 210 separates the premix air/fuel flow used for the initial ignition, for a select distance, from the flow of air/fuel used in a main combustor 300. An exact air/fuel ratio is needed for the initial ignition in the ignition chamber 240. The jet extender 210 prevents fuel delivered from the fuel injector plate 217 from flowing into the ignition chamber 240, therein unintentionally changing the air/fuel ratio in the ignition chamber 240. In this example of a jet extender 210, the jet extender includes a plurality of aligned rows of passages 211 through a mid portion of the jet extender's body. The plurality of aligned rows 211 through the mid portion of the body of the jet extender 210 serve to achieve the desired air/fuel ratio between the ignition chamber 240 and the main combustor 300. This provides passive control of ignition at the intended air/fuel ratio of the main combustor 300.

Figure 6A:
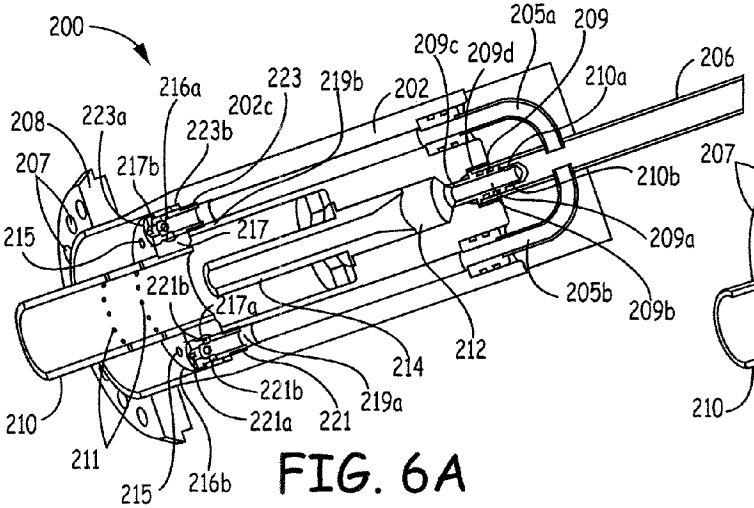
FIG. 6A is a cross-sectional view along line 3A-3A of the combustor of FIG. 5.

As discussed above, the jet extender 210 extends from a central passage of a fuel injector plate 217. As FIGS. 6A and 6B illustrate, the injector plate 217 is generally in a disk shape having a select height with a central passage. An outer surface of the injector plate 217 engages an inner surface of the injector body 202 near and at a select distance from the second end 202*b* of the injector body 202. In particular, a portion of a side of the injector plate 217 abuts an inner ledge 202*c* of the injector body 202 to position the injector plate 217 at a desired location in relation to the second end 202*b* of the injector body 202. The injector plate 217 includes internal passages 217*a* and 217*b* that lead to fuel exit passages 215. Chokes 221 and 223 are positioned in respective openings 219*a* and 219*b* in the internal passages 217*a* and 217*b* of the injector plate 217. The chokes 221 and 223 restrict fuel flow and distribute the fuel flow through respective choke fuel discharge passages 221*a* and 223*a* that exit the injector plate 217 as well as into the internal passages 217*a* and 217*b* of the injector plate 217 via a plurality of openings 221*b* and 223*b*. Fuel passed into the internal passages 217*a* and 217*b* exit out of the injector plate 217 via injector passages 215.

The fuel inlet tube 206 provides fuel to the combustor 200. In particular, as illustrated in FIG. 6A, an end of the fuel inlet tube 206 receives a portion of a premix fuel inlet member 209. The premix fuel inlet member 209 includes inner cavity 209*a* that opens into a premix chamber 212. In particular, the premix fuel inlet member 209 includes a first portion 209*b* that fits inside the fuel inlet tube 206. The first portion 209*b* of the premix fuel inlet member 209 includes premix fuel passage inlet ports 210*a* and 210*b* to the inner cavity 209*a*. Fuel from the fuel inlet tube 206 is passed through the premix fuel passage inlet ports 210*a* and 210*b* and then into the inner cavity 209*a* to the premix chamber 212. The premix fuel inlet member 209 further includes a second portion 209*c* that is positioned outside the fuel inlet tube 206. The second portion 209*c* of the premix fuel inlet member 209 is coupled to the premix chamber 212. The second portion 209*c* further includes an engaging flange 209*d* that extends from a surface of the fuel inlet tube 206. The engaging flange 209*d* engages the end of fuel inlet tube 206. In one embodiment, a seal is positioned between the engaging flange 209*d* and the end of the inlet tube 206. Although not shown, another end of the fuel inlet tube 206 is coupled to an internal passage in the housing of the downhole combustor 200 to receive fuel. As also illustrated in FIG. 6A, branch fuel delivery conduits 205*a* and 205*b*, coupled to the fuel inlet tube 206, provide a fuel flow to the respective chokes 221 and 223 in the fuel injector plate 217. As illustrated in FIG. 6B, the premix air inlet 204 provides air to the premix chamber 212. The air/fuel mix is then passed to the air/fuel premix injector 214, which distributes the fuel/air mixture into an initial ignition chamber 240. The initial ignition chamber 240 is lined with insulation 220 to minimize heat loss. The air/fuel mixture from the premix injector 214 is ignited via one or more glow plugs 230*a* and 230*b*.

Figure 7:
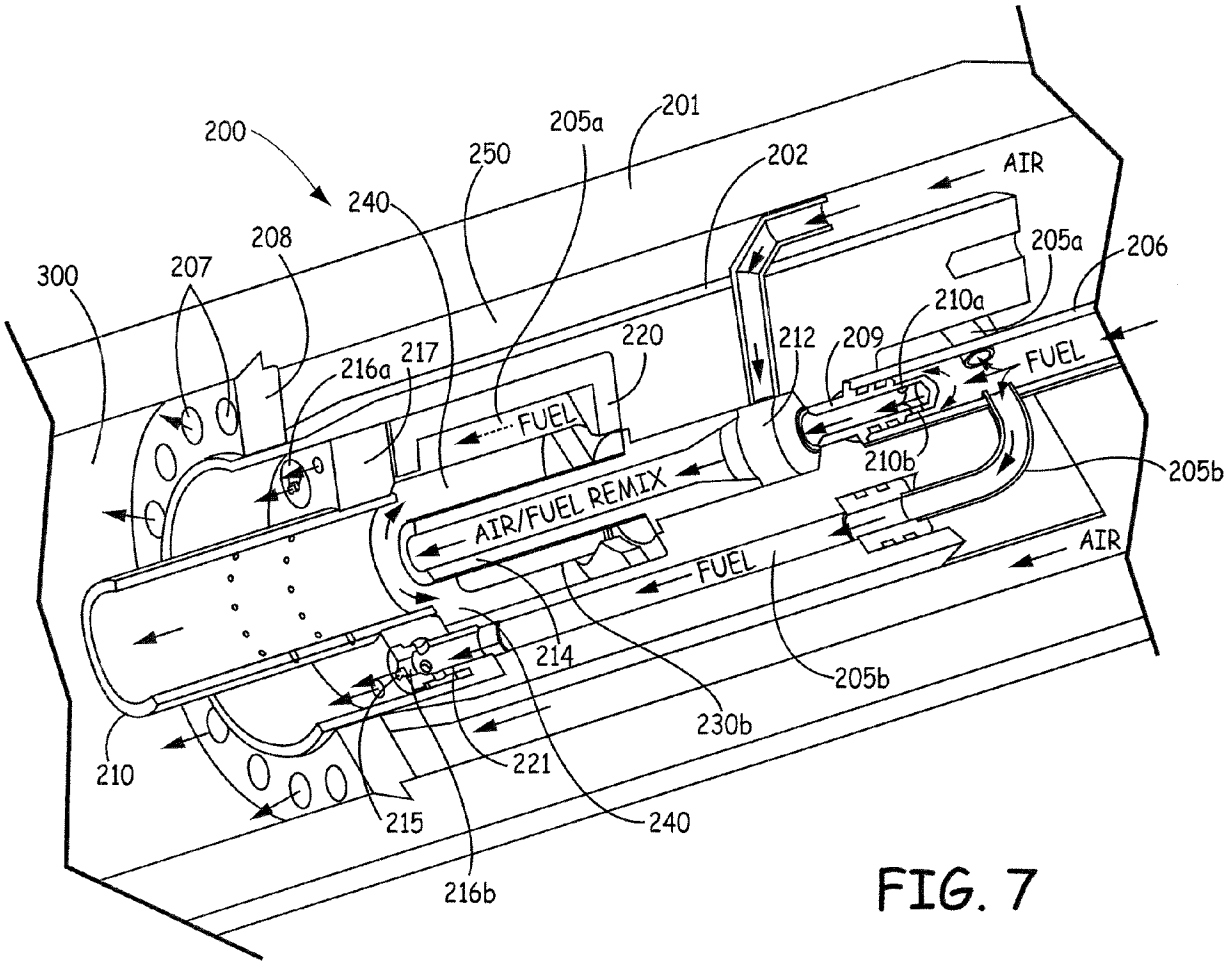
FIG. 7 is a cross-sectional side view of the combustor of FIG. 5 illustrating gas flow through the combustor.

Referring to FIG. 7, a description of the operation of the combustor 200 is provided. Fuel, such as but not limited to methane, is delivered through passages in the housing 201 to the fuel inlet tube 206 under pressure. As illustrated, the fuel passes through the fuel inlet tube 206 into the plurality of branch fuel delivery conduits 205*a* and 205*b* and into the premix fuel inlets 210*a* and 210*b* of the premix fuel inlet member 209. Although only two branch fuel delivery conduits 205*a* and 205*b* and two premix fuel inlet ports 210*a* and 210*b* to the premix fuel inlet member 209 are shown, any number of fuel delivery conduits and premix fuel inlets could be used and the present invention is not limited by the number. Fuel entering the premix fuel inlet ports 210*a* and 210*b* of the premix fuel inlet member 209 is delivered to the premix chamber 212 where it is mixed with air from the premix air inlet 204, as discussed below. Fuel passing through the branch fuel delivery conduits 205*a* and 205*b* is delivered to the chokes 221 and 223 and out the fuel injectors 216*a* and 216*b* and fuel passages 215 in the fuel injector plate 217 to provide a flow of fuel for the main combustion chamber 300.

Air under pressure is also delivered to the combustor 200 through passages in the housing 201. In this embodiment, air under pressure is in an annulus 250 between the injector body 202 and the housing 201. Air further passes through air passages 207 in the air swirl plate 208 therein providing an air flow for the main combustion chamber 300. As illustrated, some of the air enters the premix air inlet 204 and is delivered to the premix chamber 212. The air and the fuel mixed in the premix chamber 212 are passed on to the air/fuel premix injector 214 which is configured and arranged to deliver the air/fuel mixture so that the air/fuel mixture from the air/fuel premix injector 214 swirls around in the initial ignition chamber 240 at a relatively low velocity. One or more glow plugs 230*a* and 230*b* (230*a* not shown) heat this relatively low velocity air/fuel mixture to an auto-ignition temperature wherein ignition occurs. The combustion in the initial ignition chamber 240 passing through the jet extender 210 ignites the air/fuel flow from the fuel injector plate 217 and the air swirl plate 208 in the main combustion chamber 300. Once combustion has been achieved in the main combustion chamber 300, power to the glow plugs 230*a* and 230*b* is discontinued. Hence, combustion in the initial ignition chamber 240 is a transient event so that the heat generated will not melt the components. The period of time the glow plugs 230*a* and 230*b* are activated to ignite the air/fuel mix in the initial ignition cavity 240 can be brief. In one embodiment it is around 8 to 10 seconds.

In an embodiment, an air/fuel equivalence ratio in the range of 0.5 to 2.0 is achieved in the initial ignition chamber 240 via the air/fuel premix injector 214 during initial ignition. Concurrently, the air/fuel equivalence ratio in the main combustion chamber 300 is in the range of 0.04 to 0.25, achieved by the air swirl plate 208 and the fuel injector plate 217. After ignition of the flow in the initial combustion chamber 240 and the main combustion chamber 300, the glow plugs 230*a* and 230*b* are shut down. An air/fuel equivalence ratio within a range of 5.0 to 25.0 is then achieved within the initial ignition chamber 240, while concurrently, an air/fuel equivalence ratio in the range of 0.1 to 3.0 is achieved in the main combustion chamber 300, by the air swirl plate 208 and the fuel injector plate 217. This arrangement allows for a transient burst from the initial ignition chamber 240 to light the air/fuel in the main chamber 300, after which any combustion in the initial ignition chamber 240 is extinguished by achieving an air/fuel equivalence ratio too fuel rich to support continuous combustion. To cease combustion in the main combustion chamber 300 either or both the air and the fuel is shut off to the combustor 200.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A fracturing apparatus comprising:

a housing configured to be positioned down a wellbore and having at least one injection port at a distal end thereof;

an injection fluid supply interface operably coupled to the housing to provide injection fluid for the fracturing apparatus to an interior of the housing; and at least one high pressure combustor received within the housing, the housing having a combustible medium interface in fluid communication with the at least one high pressure combustor, the at least one high pressure combustor configured and arranged to provide repeated ignition cycles, each ignition cycle including a fuel delivery cycle to deliver a combustible medium to the combustor and a combustion cycle to ignite the delivered combustible medium to generate pressure resulting from combustion of the combustible medium during the combustion cycle to force the injection fluid out the at least one injection port.

2. The fracturing apparatus of claim 1, wherein the at least one injection port is a plurality of spaced injection ports positioned around a cylindrical side portion of the housing.

3. The fracturing apparatus of claim 1, further comprising:

a flow control valve selectively covering the at least one injection port, the flow control valve configured to permit flow through the at least one injection port when an amount of pressure inside the housing greater than a pressure outside the housing is applied to the flow control valve.

4. The fracturing apparatus of claim 1, wherein the housing further includes an injection volume holding chamber positioned to receive and mix injection fluid received from the injection fluid supply interface with gases from combustion of the combustion medium.

5. The fracturing apparatus of claim 4, further comprising:

an injection fluid conduit providing a path within the housing between the injection fluid supply interface and the injection volume holding chamber.

6. The fracturing apparatus of claim 4, further comprising:

a combustion tube in communication with the at least one high pressure combustor for combustion of the combustible medium and comprising a venturi for exhaust of combustion gases into the injection volume holding chamber.

7. The fracturing apparatus of claim 1, further comprising:

a piston assembly received within the housing, the piston assembly located and configured to apply pressure to injection fluid within the housing in response to gases generated by ignition of the combustible medium during the combustion cycle.

8. The fracturing apparatus of claim 7, the piston assembly including:

a combustion piston head;

an injection fluid piston head; and a connection shaft extending between and coupled to the combustion piston head and to the injection fluid piston head.

9. The fracturing apparatus of claim 8, wherein the housing further includes a primary combustion chamber and a secondary combustion chamber, the combustion piston head movably received within the primary and secondary combustion chambers, the combustion piston head dividing the primary combustion chamber from the secondary combustion chamber;

the at least one high pressure combustor includes a primary combustor positioned to combust the combustible medium in the primary combustion chamber and a secondary combustor positioned to combust the combustible medium in the secondary combustion chamber; and the injection fluid piston head positioned in an injection volume holding chamber in the housing, the piston assembly configured and arranged so that gas pressure from ignition of the combustion medium in the primary combustion chamber acts on the combustion piston head in a direction to cause the injection fluid piston head to push the injection fluid out of the injection volume holding chamber through the at least one injection port and gas pressure from ignition of the combustible medium in the secondary combustion chamber acts on the combustion piston head in an opposing direction to cause the injection fluid piston head to draw injection fluid from the injection fluid supply interface into the injection volume holding chamber.

10. The fracturing apparatus of claim 9, further including a low pressure chamber positioned within the housing between the secondary combustion chamber and the injection volume holding chamber.

11. A fracturing apparatus comprising:

a housing configured to be positioned down a wellbore, the housing having an injection fluid supply interface and a combustible medium interface proximate an end of the housing, a plurality of spaced injection ports proximate an end of the housing opposite the injection fluid supply interface and the combustible medium interface, and an injection volume holding chamber proximate the plurality of injection ports;

the injection fluid supply interface in communication with the injection volume holding chamber through an injection fluid conduit; and at least one high pressure combustor located within the housing in communication with the combustible medium interface, the at least one high pressure combustor configured and arranged to provide repeated ignition cycles, each ignition cycle including a fuel delivery cycle to deliver a combustible medium to the at least one high pressure combustor and a combustion cycle to ignite the combustible medium and generate pressure resulting to force the injection fluid out of the injection volume holding chamber through the plurality of injection ports.

12. The fracturing apparatus of claim 11, further comprising:

a flow control valve for selectively preventing flow through the plurality of spaced injection ports, the flow control valve configured to allow flow through the plurality of spaced injection ports when a pressure within the injection volume holding chamber in excess of a pressure exterior to the housing is applied to the flow control valve.

13. The fracturing apparatus of claim 11, further comprising:

a combustion tube in communication with the at least one high pressure combustor for combustion of the combustible medium and comprising a venturi for exhaust of combustion gases into the injection volume holding chamber.

14. The fracturing apparatus of claim 11, further comprising:

a piston assembly received within the housing, the piston assembly configured to apply pressure to the injection fluid in the injection volume holding chamber in response to gases generated by ignition of the combustible medium during the combustion cycle.

15. The fracturing apparatus of claim 14, the piston assembly including:

a combustion piston head;

an injection fluid piston head spaced from the combustion piston head;

a connection shaft coupled to and extending between the combustion piston and the injection fluid piston head;

the housing further including a primary combustion chamber and a secondary combustion chamber, the combustion piston head movably received within and dividing the primary and secondary combustion chambers;

the at least one high pressure combustor including a primary combustor positioned to combust combustible medium in the primary combustion chamber and a secondary combustor positioned to combust the combustible medium in the secondary chamber; and the injection fluid piston head positioned in an injection volume holding chamber in the housing, the piston assembly configured and arranged so that ignition of the combustible medium in the primary high pressure combustor acts on the combustion piston head to cause the injection fluid piston head to push the injection fluid out of the injection volume holding chamber through the plurality of injection ports and ignition of the combustible medium in the secondary combustion chamber acts on the combustion piston head to cause the injection fluid piston head to draw injection fluid into the injection volume holding chamber.

16. A method of downhole fracturing, the method comprising:

cyclically combusting a combustible medium within a combustor located in a housing disposed in a well bore to pressurize an injection fluid contained within the housing; and cyclically exhausting the pressurized injection fluid from the housing into the wellbore in communication with a subterranean formation to cause micro fracturing therein.

17. The method of claim 16, further comprising:

forcing the injection fluid out the housing through a plurality of injection ports responsive to pressure within the housing exceeding a predetermined differential with respect to pressure exterior to the housing.

18. The method of claim 17, further comprising:

generating, within the housing, a warm high content foam greater than 50% gas by volume by combining hot exhaust gas from combustion of the combustible medium with the injection fluid.

19. The method of claim 18, further comprising:

using low gas content foam formed by cooling and condensation of the hot exhaust gas with high bulk molecules to support fractures deeper into the formation.

20. The method of claim 16, further comprising:

augmenting cyclical pressure generated by combustion of the combustible medium by the at least one downhole combustor with ignition of a solid propellant.

* * * * *